US007056211B2

(12) United States Patent
Taltavull et al.

(10) Patent No.: US 7,056,211 B2
(45) Date of Patent: Jun. 6, 2006

(54) DEVICE AND PROCEDURE FOR RANDOM DRAWS BASED ON THE MODALITY OF PRIOR REALIZATION OF THE DRAW

(76) Inventors: Armando Hector Taltavull, Luis Maria Campos 1616, 2°D, Buenos Aires (AR) C1426BPN; Carlos Isidoro Ferrari, Luis Maria Campos 1616, 2°D, Buenos Aires (AR) C1426BPN ( * ) Notice: Subject to any disclaimer, the term of this patent is extended or adjusted under 35 U.S.C. 154(b) by 350 days.

(21) Appl. No.: 10/298,076

(22) Filed: Nov. 15, 2002

(65) Prior Publication Data

US 2003/0199296 A1 Oct. 23, 2003

(30) Foreign Application Priority Data

Nov. 15, 2001 (AR) ..... P010105326

(51) Int. Cl.
*A63F 9/22* (2006.01)

(52) U.S. Cl. ..... 463/17; 463/13

(58) Field of Classification Search ..... 463/13, 463/17

See application file for complete search history.

(56) References Cited

U.S. PATENT DOCUMENTS 3,749,007 A * 7/1973 Kagele et al. ..... 101/93.29
4,373,726 A * 2/1983 Churchill et al. ..... 463/19
4,677,553 A * 6/1987 Roberts et al. ..... 463/17
4,747,600 A * 5/1988 Richardson ..... 463/19
4,832,341 A * 5/1989 Muller et al. ..... 463/17
4,858,123 A * 8/1989 Alexoff et al. ..... 101/484
4,943,090 A * 7/1990 Fienberg ..... 273/139
4,982,337 A * 1/1991 Burr et al. ..... 700/235
5,014,991 A * 5/1991 Mirando et al. ..... 463/16
5,088,737 A * 2/1992 Frank et al. ..... 463/18
5,222,624 A * 6/1993 Burr ..... 221/1
5,239,165 A * 8/1993 Novak ..... 235/375
5,290,033 A * 3/1994 Bittner et al. ..... 463/25
5,624,119 A * 4/1997 Leake ..... 273/269
5,788,237 A * 8/1998 Fults et al. ..... 273/269

(Continued)

FOREIGN PATENT DOCUMENTS

AR AA 018429 11/2001

(Continued)

OTHER PUBLICATIONS

Fay, Slot MAchines, A Pictroia History of the First 100 Years, Liberty Bell Books, 1983, p. 231.*

*Primary Examiner*—Corbett Coburn
(74) *Attorney, Agent, or Firm*—Volpe and Koenig, P.C.

(57) ABSTRACT

A gaming machine device is provided for the resolution of the modality of prior draw for installation in an anthropometrical position that facilitates display to allow a player's interaction in a game. The device includes: a central processing unit connected to a monitor, a first interface connected to a reduced alphanumeric keyboard with betting slots, a second interface connected to a printer, and a random draw device. A receptacle attached to the printer output includes: an upper side made of transparent material, an input slot facing the printer output that receives a draw element, occlusion means under the transparent material for hiding the results of an executed draw printed on a side of the draw element visible to the player, and an output slot through which the draw element is handed over to the player. A method for resolution of the modality of prior draw is also provided.

11 Claims, 6 Drawing Sheets

U.S. PATENT DOCUMENTS

| | | | | |
|---|---|---|---|---|
| 6,244,596 | B1 * | 6/2001 | Kondratjuk | 273/143 R |
| 6,648,755 | B1 * | 11/2003 | Luciano et al. | 463/17 |
| 6,840,860 | B1 * | 1/2005 | Okuniewicz | 463/35 |
| 2002/0094860 | A1 * | 7/2002 | Itkis et al. | 463/19 |

FOREIGN PATENT DOCUMENTS

| | | | |
|---|---|---|---|
| EP | 542664 | A2 * | 5/1993 |
| WO | WO 9535207 | A1 * | 12/1995 |

* cited by examiner

DEVICE AND PROCEDURE FOR RANDOM DRAWS BASED ON THE MODALITY OF PRIOR REALIZATION OF THE DRAW

SUMMARY

The object of this invention is to create a device and procedure for random draws based on the modality of prior realization of the draw. The device in the invention has been designed for application in any type of game machine and allows the player to place his bet after the draw has been done. This implies that once the random draw has been executed for the game that has been selected, in whichever manner that is appropriate, be it mechanical, electronic or computerized, the result is printed, but not displayed to the bettor, on the visible side of the paper, bristol board, plastic or any other material used for this purpose so that it is possible for the bettor to decide on his bet with the certainty that regardless of the method used to execute the draw, the result, once printed, would be inalterable.

In a selected case study, as viewed from front, the abovementioned printing process would include print columns in the direction of emission of the draw element, in which the element located to the extreme right of the draw element, would contain the result of the draw or draws executed and the column or columns to it's left, which is visible to the bettor would contain only data which is inherent to the modalities of the game selected or to the ordinal position that corresponds to the result of the draw printed in the right column.

The abovementioned printed draw element is partly visible to the bettor, with it's left columns being visible to him, while the column containing the results of the draw (the right column) is momentarily hidden from view, by means of appropriate mechanisms or elements which will be activated during the course of the game.

It must be highlighted here that the output from the printer of the abovementioned draw element, is produced in a sealed receptacle or cubicle. The visible side of this receptacle is made of a transparent material (glass, plastic etc), while the covering material to conceal the area or the column containing the printed result or results of the draw is located under this transparent material.

Immediately under the covering material is where the draw element would be located.

With this device the resolution of all types of games is done in an innovative manner, with it's most important feature being that, once the draw is executed and the result printed on the above-mentioned draw element, the player is able to place his bet in an interactive manner with the draw executed, as it is possible that for the same draw there may be various different and valid resolutions, based on the specific criteria that each player applies while defining his bet. Besides, the bettor is always sure that the result of the draw executed beforehand, cannot be altered in any way, as the draw element is converted into an inalterable document containing the result of the draw executed prior to his placing the bet.

The device according to the invention is universal, that is to say it can be applied to any existing game machine, which you wish to adapt to this modality, or to new machines, which could utilize the innovative feature of the inalterable prior printing of the result of the draw executed.

Besides the functions described above, the implementation of this device, which is the object of this invention, offers increased and innovative options for the resolution of a bet.

An extremely important feature of the device in question is the positioning of the covering material with the help of which the numbers, symbols or characters resulting from a random draw and printed on the draw element can be hidden from view momentarily.

The covering material referred to, in this particular case study, comprises a string of individual plates arranged one beside the other, in the normal direction of the print output covering the column or that part of the draw element where the results of the draw executed are printed. That is to say from top to bottom, with the special feature that in order to reveal the results of the draw at one go these can be displaced simultaneously towards the right, thus completely revealing the draw element, or it can be done unit wise revealing only some part of the area that contains the printed result of the draw in question.

It is this feature, which also offers the possibility of different combinations of resolutions in the course of a particular session. This means that for a single draw there can be various valid resolutions, depending exclusively on the choice of the bettor.

There are many conventional resources to carry out this objective and function, which has been described above. These include (exclusively for cases using the modality of the prior execution of the draw) methods or procedures such as the traditional "scratch to see" method, where the result of a draw, which has been executed beforehand, is printed on paper. Once it is printed, it is covered by a film of polyethylene (or any other appropriate substance), which sticks to the printed surface. To complete the process to cover the result of the draw, the area containing the printed result of the draw in the form of numbers, symbols or characters is printed over with metallic ink.

The bettor, by scratching the said area with a coin or other appropriate means, completes the process for resolution of the game.

Although this modality fully complies with the expectations for the purpose for which it was created, this procedure is not very suitable for application in machines which have to select from various types of games as these draws include a single modality of resolution that is by scratching the part containing the result of the draw executed beforehand.

The primary disadvantage in such a situation (besides others) is the impossibility of at least being able to use part of the draw element to exchange substantial information with the bettor, which is inherent to the type and modality of the game selected, besides impeding the culmination of a given session in a specific and interactive manner with the player.

There are innumerable mechanisms, instruments and devices meant for the execution of random draws in several games. A majority of them are delicate high precision mechanical elements that are costly (as in the case of roulettes in casinos) which act in combination in a sealed environment (in the case of the roulette, a wheel containing 37 slots with the numbers 0 to 36) to produce a physical event subject to the resolution of an intrinsically random fact. It is so in the case of a ball, which is shot in the direction opposite to the rotation of the plate, with variable force and speed whose movement between the direction of the shot and the rotating plate is unpredictable. Almost all random game devices are based on this principle.

The other way in which certain random events can be generated is by using computerized media. Even if it is a quality, which is well appreciated especially in scientific areas such as computerized simulation, the machine itself possesses the conditions to alter these random data according to the software loaded. This duality, in many cases, impedes the utilization of the excellent advantages of computers in games of chance.

The device according to the present invention represents an ingenious procedure, which allows random generation of the result without the possibility of manipulation of the data generated, as it is impossible to modify or alter the results of the original draw. This ensures reliability as well as the possibility of the player's interactive role in a draw executed beforehand. It also makes the emulation of any existing game devices or the creation of new games using the advantages of computerized resolution of the process possible.

The device in according to the invention, clearly overcomes the abovementioned disadvantages, given the advantages demonstrated in having part of the draw element hidden and part exposed to the player. It demonstrates the bi-unique correspondence of the visible part of the given draw element to the temporarily hidden part containing the result of the draw executed beforehand in the game selected.

This aspect plays a fundamental role in the player's confidence in the procedure, in the certification of the selected modality, as well in the exact location of each element of the draw executed, and the element containing the printed result which is partially visible to the player at all times.

This fact allows for greater interactivity of the player, thus widening the scope of the application and resolution of various games and their modalities, such as the selection of a position of choice to place the bet etc.

The second feature to be kept in mind in this patent application is the possibility of selection of positions and arrangement (described in detail above) of the elements in the device at the time of displaying the hidden part of the draw element.

This is only possible due to the bi-unique relationship between the print visible to the player in the said draw element and the covering material, which eventually reveals the hidden part containing the results of the draw.

Therefore, it is apparent that for certain betting methods, it is extremely important to have control over the manner in which the hidden part of the print is displayed.

The final resolution of the betting process would depend on these cases, in the manner and sequence in which certain hidden parts of the result of the draws executed are revealed, with full participation by the bettor during the process of resolution of the game in question.

The device in this example is formed of a set of plates arranged in continuation and in the normal direction of the output of the draw element, (in this case covering all the positions of the right column) arranged in such a manner that each one of them covers the exact place where each of the positions of the symbols or numbers in the draw executed are located, leaving it to the criteria of the bettor to decide the sequence in which these positions would be revealed.

It must be explained here that one of the appropriate ways to move these plates is by using electromagnetic coils with spring return, as is common in conventional mechanisms. Another method is by the use of liquid quartz crystals (like the ones utilized in the displays of electronic calculators) with these elements transforming from a state of total transparency to complete darkening when they are polarized by the application of electrical current.

A third method of concealment would be in the alternative filling and emptying of containers with the appropriate format, positioned in the areas that are to be hidden (in the position which the plates would occupy) with the objective that when they are filled with mercury or highly pigmented ink, they would cover the desired areas. The activation of the liquid elements is done through small electrically driven pistons.

This very observation definitively reaffirms the fundamental reasoning of this application for patent on the real possibilities of game methods using the modality of a draw executed beforehand, with the printed part visible to the bettor. It is clearly demonstrated how this printing of the result increases the range of possibilities in different betting games given the reliability of the procedure besides the other advantages described above.

BRIEF DESCRIPTION OF THE DRAWINGS

A preferred embodiment of the invention is described below to show the advantages and to facilitate understanding of the constructive and functional characteristics of the device for application in game machines with resolution based on the modality of the prior execution of the draw. Regular users and those skilled in this field would be able to add many more advantages to this list. The preferred embodiment has been diagrammatically represented, without any specific scale, in the sheets attached, with the expressed clarification that precisely because it is only one preferred embodiment, a limited or exclusive character should not be assigned to the scope of protection of this invention based on the described preferred embodiment, which is intended to be merely explanatory nature.

DETAILED DESCRIPTION OF THE PREFERRED EMBODIMENTS

It is clarified that, in all the figures, the reference numbers correspond to the same or equivalent parts of elements in the set, based on the described preferred embodiment.

Figure 1:
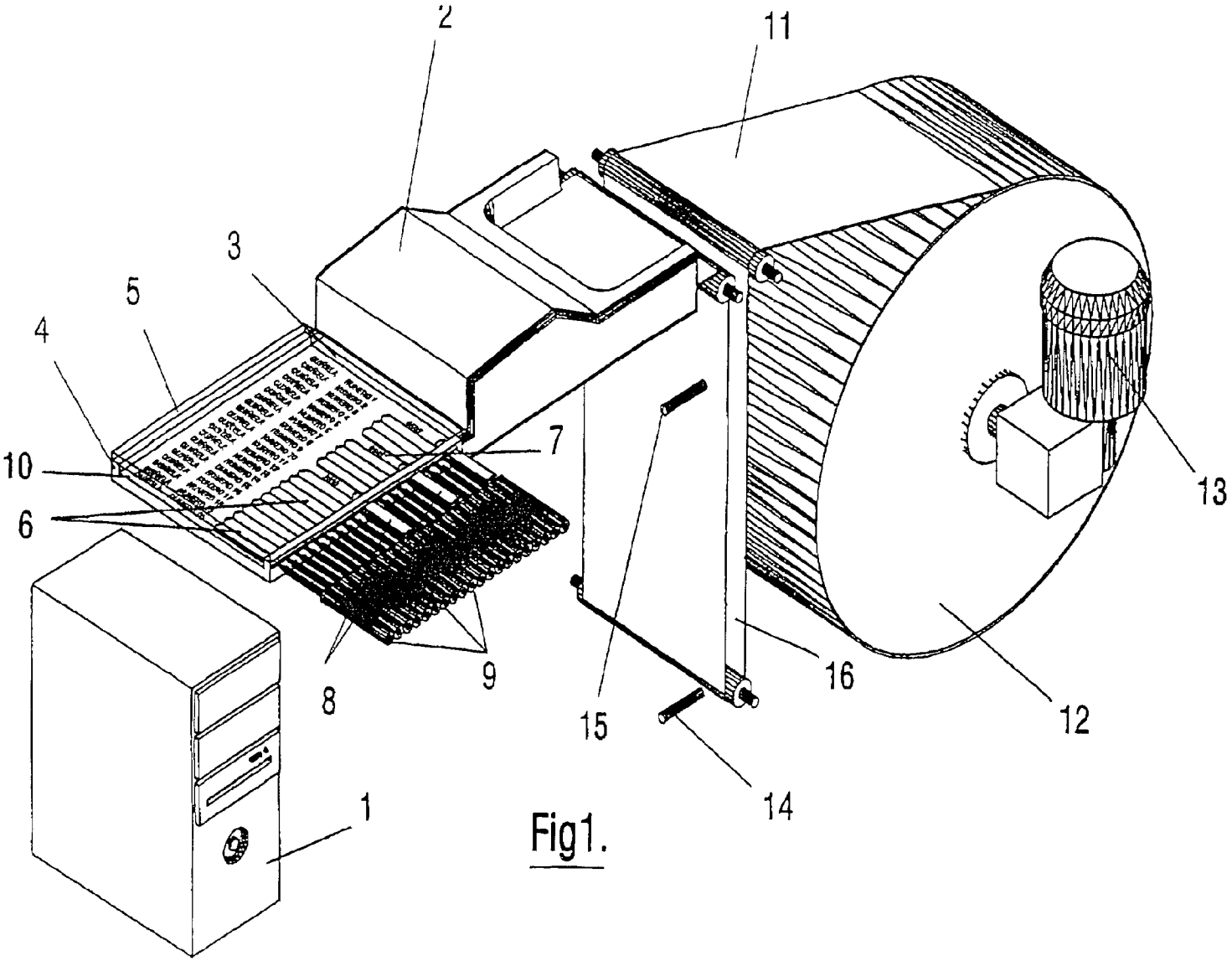
FIG. 1 is a view of the entire set of elements and mechanisms that the device is made of and their functioning for application in game machines, according to the invention.

As can be seen in FIG. 1, the device according to the invention is applied to game machines, and is specially designed for application in any type of game machines, but it's utilization acquires special significance in those in which the details of the draw are generated at random by a computerized random draw device 19 generated in a CPU or Central Processing Unit 1. This CPU 1 can also be linked to mechanical or. electrical random draw devices 17, 18 (casino roulettes, cubicles with data etc) represented by dotted lines. The CPU 1 will receive data from these mechanical or electronic random draw devices 17, 18 through an interface (not illustrated) to generate the results of the draw.

This CPU 1, through the first interface 26, controls a reduced alphanumeric keyboard 25 which includes all the keys necessary for data entry and commands, which is optional and the betting slots 21,22,23,24 which are meant for the receipt of bets by different modes of payment: magnetic, chip or credit cards, currency notes, coins or chips. The CPU 1 is in turn connected to a monitor 20 or a similar device meant for interactive visual communication with the bettor. The monitor 20 can also be a touch screen in which case the use of an alphanumeric keyboard 25 is optional. Once the results of the draw are generated, these are transmitted to the printer 2 through a second interface 27. Once this data is received in the printer 2 these are printed in a draw element 4' made of bristol board or any other suitable material and introduced through a slot 2 into a box or any other sealed receptacle 4 whose visible side, to be precise, the side which is visible to the bettor, is made of a transparent material 5 for example glass, plastic or a similar material. Located in the inner part of the closed box 4 and immediately under the transparent material 5 is the covering material 6 that completely covers the area or the column containing the results of the draw 7. In this example, the covering material 6 is a string of plates parallel and adjacent to each other and arranged perpendicular to the output of the printing element 4 as can be observed in FIGS. 1 and 3.

These plates 6 can be moved axially by means of springs 8 linked to energised electromagnetic coils 9, which activate them, releasing or contracting them as required. The movement of the covering material 6 is controlled by the CPU 1 with specific software, according to the selection made by the player. Once the draw is done, the draw element 4 comes out of the slot to be given to the bettor.

As the requirement for paper in such devices is large, a feeder with sufficient quantity of paper 11 to satisfy the requirement is required. The roll 12 is mounted on a shaft activated by a motor-reducer 13 activated in turn by stroke limits 14,15 between which is a fluctuating loop 16 maintaining a constant tension according to the required traction for the traction mechanism of the printer 2.

Figure 2:
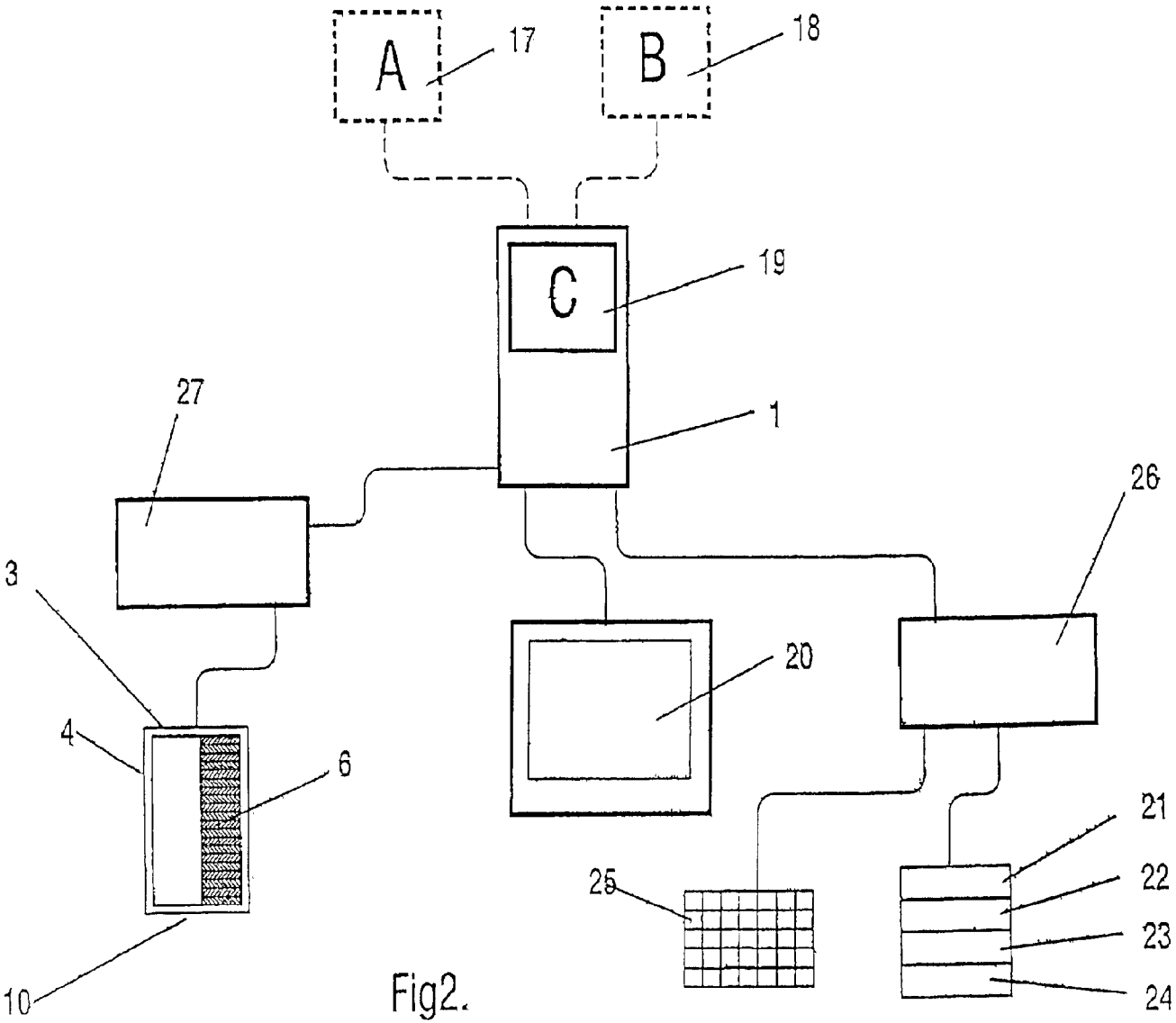
FIG. 2 is a block diagram of the invention

FIG. 2 is a diagrammatic representation of all the basic elements for the operation of the patented device.

As we have mentioned before, the elements 17 and 18, represented as dotted lines, are alternative models for possible random draw devices, such as mechanical or electronic random draw devices, which are connected through a third, interface plate (not illustrated) to the CPU 1. These mechanical or electronic devices can be casino roulette, a cubicle with data or similar devices. Nevertheless, in this example, we will refer to computerized random draw devices 19 that is to say, those generated by specific software managed by the CPU 1.

Figure 3:
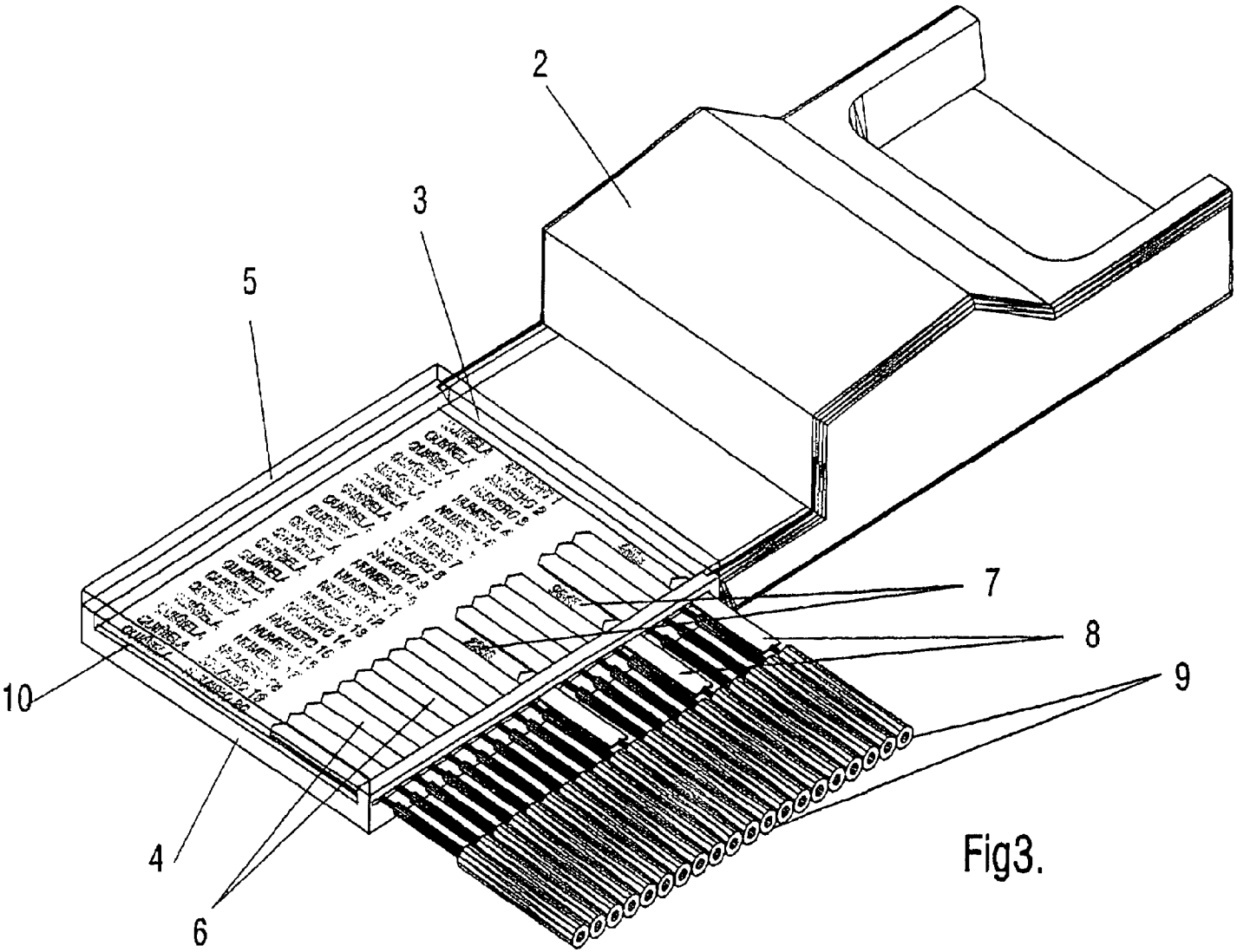
FIG. 3 is a more detailed perspective of the elements used in a device according to the invention.

In FIG. 3, the device according to the invention is represented in greater detail.

Figure 4:
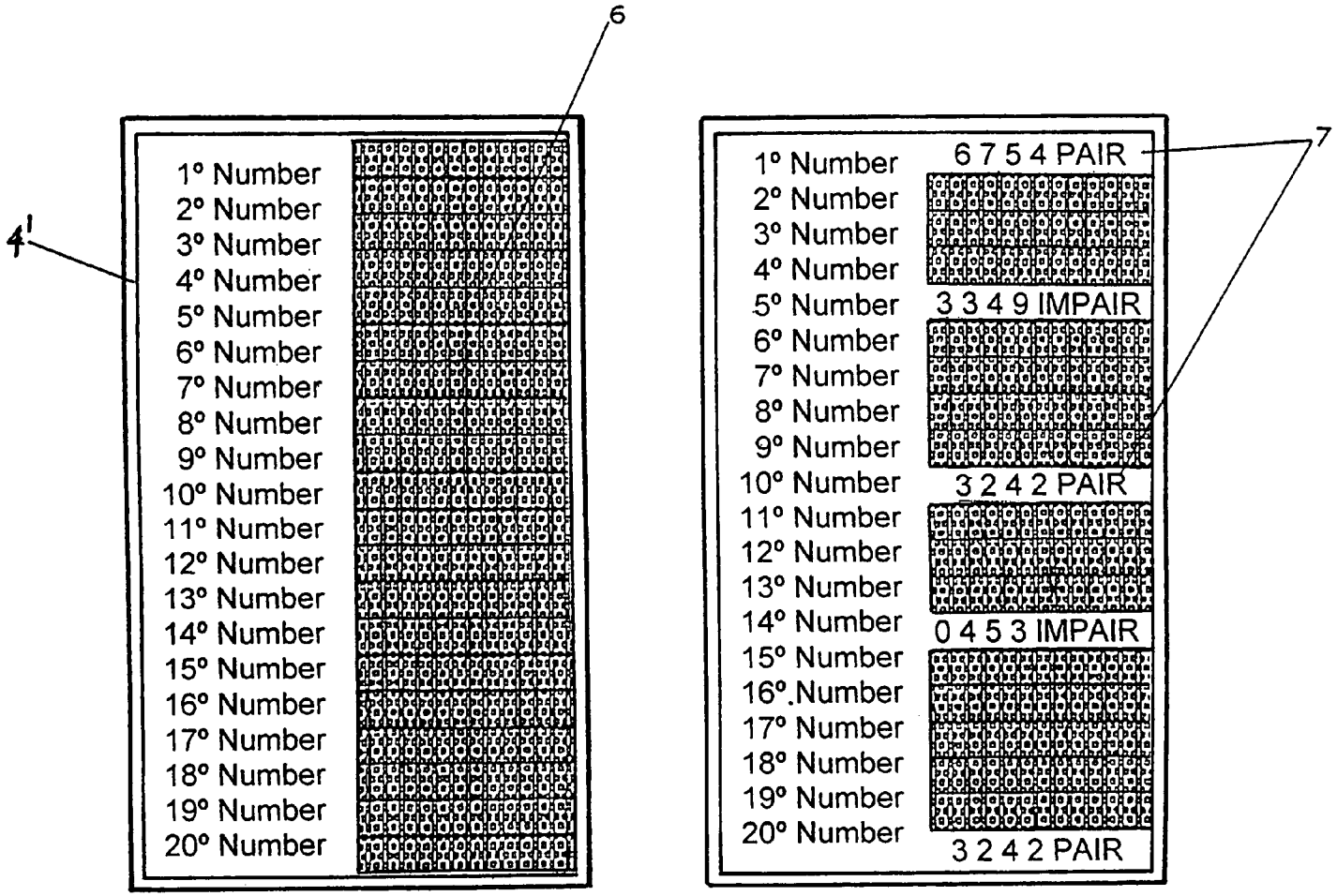
FIGS. 4, 5 and 6 illustrate different draw elements, which can be used in the device according to the invention.
Figure 5:
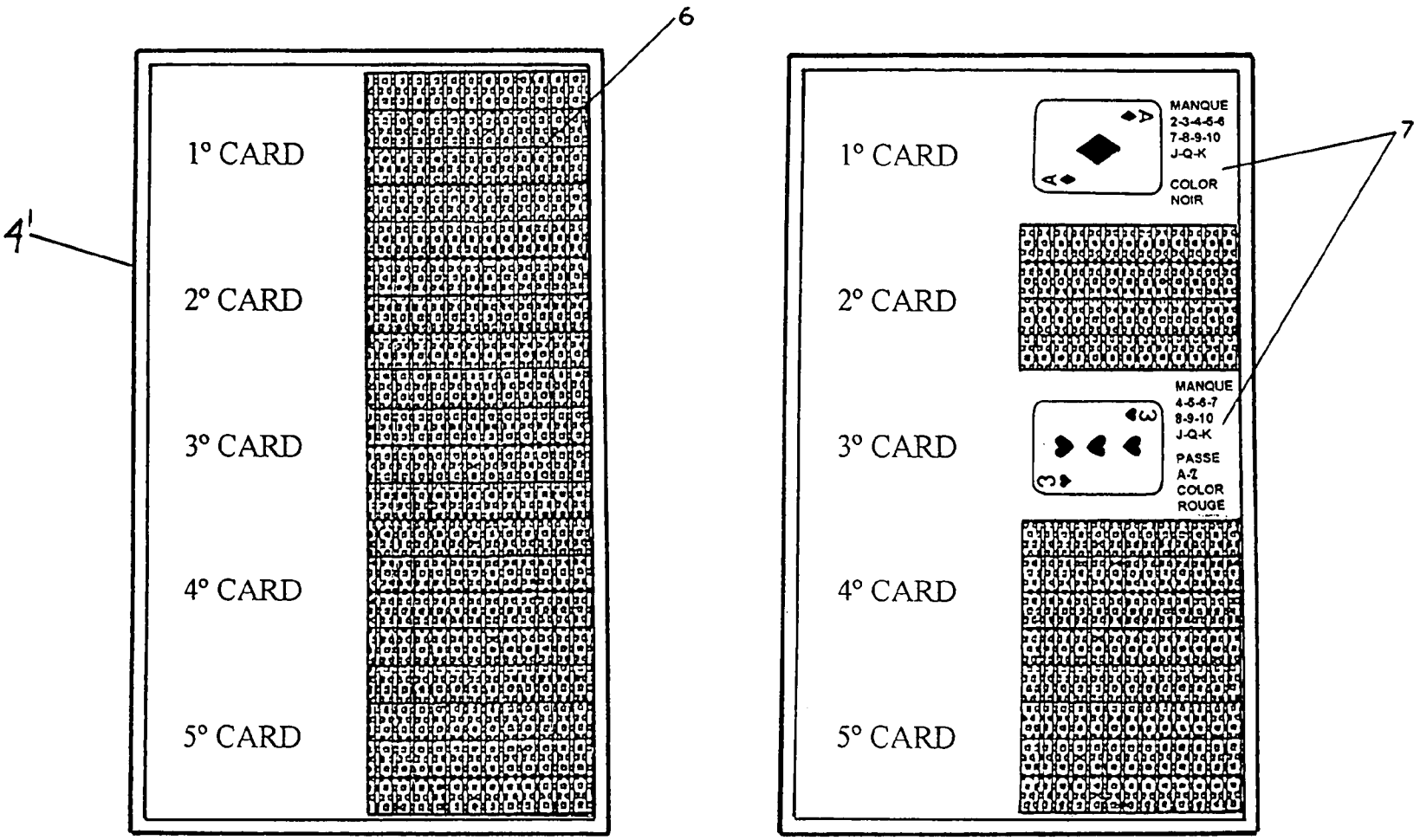
Figure 6:
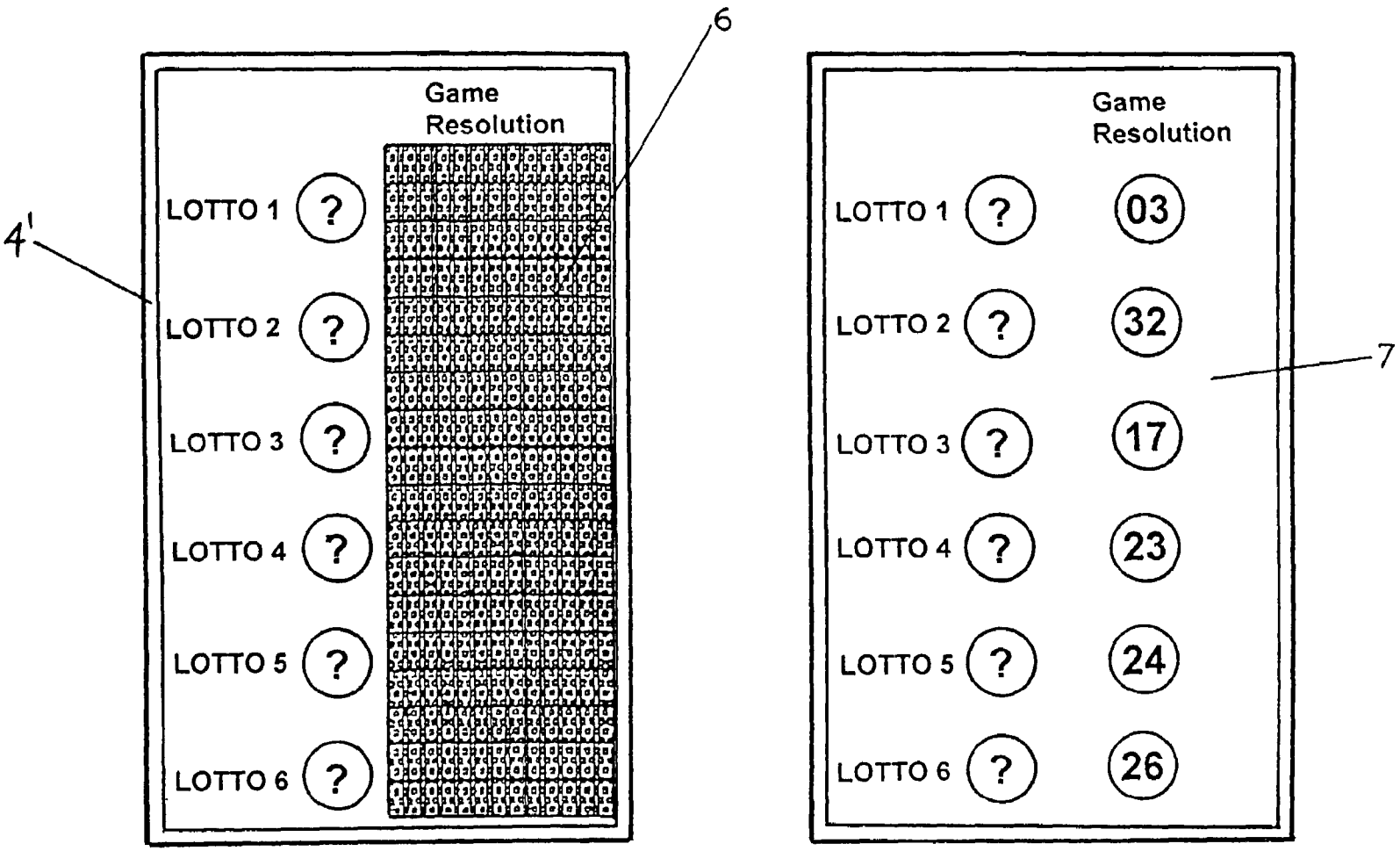

In FIGS. 4, 5 and 6, illustrative examples of the different possibilities that the device offers for implementation in different types of games with the modality of prior realization of the draw are shown. These are described as follows. When the game session is initiated, the bettor selects, from a given variety of options, the game that he wants to play by touching the screen of the monitor 20 if it is a touch screen. Otherwise, he would have to do so with the reduced alphanumeric keyboard 25. Immediately after this selection the CPU 1 carries out the appropriate random draw for the modality selected.

For example: if the bettor selects the modality Quiniela Draw as shown in FIG. 4, the random selection device 19 generates 20 numbers at random from 1 to 20 in the corresponding order, the first number would be the winner, the second would come second place and so on successively. 20 would be the twentieth. Once the draw has been made (by any of the means described), the draw element 4 is deposited in the display device with the column where the result is hidden by means of the covering material 6. At this point the bettor can select his game strategy. For example the bettor could bet 10 pesos on the last two digits of the draw which are in the fifth position (if he is right he could win 700 pesos) when the covering 6 on the fifth position is removed, the player would know if he won or lost his last bet. If he won there would be a large variety of possible actions that is: If he won he could:

Withdraw

Could request to bet everything on two, three or four digits in another position;

He could also accumulate his winnings and request for a new draw;

If he lost he could:

Withdraw

He could place bets on the other positions in the same draw.

Having won this bet he could then repeat Step 2.

The game of Quiniela has three modalities, which are:

Exact—This signifies that the bettor places his bet on a given position, from the first to the twentieth, on 2, 3 or 4 digits as the sole object of his bet.

Redoubling—this signifies that the player selects a position beforehand in which he bets on the last two digits, and the possible winnings to another position also specified beforehand, in which he would also bet on the last two digits of this position whose value has been pre defined.

Prize—This situation occurs when the bettor selects a number of 2, 3 or 4 digits and indicates the range of positions in which the selected number can figure. For example No. 3124 between positions 5 and 12 including these.

The other possibilities of alternative games follow the same philosophy, of course each governed by their own intrinsic rules, which can be applied with complete flexibility thanks to the device in accordance with the invention.

While each game could be described in detail, this would only be a description of the rules specific to each of the games.

It is thus demonstrated in the previous example that the manner of operating the covering material 6 which is instrumental in displaying the hidden part of the draw element 4' allows for greater interaction between the player and the objects; symbols; characters or numbers in the game in question, thus ensuring a very wide range of sequences and methodologies of resolution of these games.

FIG. 5 (Poker) and FIG. 6 (lotto) are examples of resolution by applying the methods described.

Thus the procedure for this invention constitutes the following stages:

a) select the draw modality using the reduced alphanumeric keyboard 25 or the touch screen monitor 20, as applicable, which is then communicated to the central processing unit 1 through a first interface plate 26;

b) activate the random draw device 19 which is connected to the central processing unit 1 which would carry out the appropriate random draw for the modality of the draw selected;

c) print the result of the draw executed by the said random draw device 19 in a draw element 4', partially visible to the player, by means of a second interface plate 27 which connects the central processing unit 1 with a printer 2;

d) transfer the draw element 4' to a transparent receptacle 4 which houses the covering material 6 to cover part of the draw element 4' on which the results of the draw are printed;

e) deposit the amount to be betted through any of the slots for betting 21,22,23,24;

f) place the bet on the basis of the modality of the draw selected in step a) using the reduced alphanumeric keyboard 25 or the touch screen monitor 20;

g) once the betting process is completed, at one go or sequentially according to the modality of the draw selected, deactivate the covering plates 6 that are covering the column of the draw element 4' which contains the results of the draw;

h) repeat steps e); f) and g) as required according to the modality of the draw selected in step a) and/or according to the preference of the one placing the bet or otherwise hand over the printed draw element 4' to the bettor as proof of the draw carried out.

The invention claimed is:

1. A gaming machine device for the resolution of the modality of prior draw, suitable for installation in existing or new machines in an anthropometrical position that facilitates display in a manner that allows a player's interaction in a game, said machine comprising a central processing unit connected to:

a) a monitor;

b) a first interface which in turn is connected to a reduced alphanumeric keyboard with betting slots;

c) a second interface which is in turn connected to a printer; and d) a random draw device, said gaming machine device further comprising a receptacle attached to an output of said printer, said receptacle having:

an upper side that is made of transparent material;

an input slot, facing the output of the printer that receives a draw element;

occlusion means for hiding the results of an executed draw printed on a side of the draw element visible to the player, wherein the occlusion means are positioned immediately under the transparent material; and an output slot through which the draw element is handed over to the player once a game is over.

2. Device according to claim 1, wherein the occlusion means comprise opaque plates connected to electromechanical media by springs.

3. Device according to claim 2, wherein the electromechanical media are electromagnetic coils which are activated by the second interface connected to the central processing unit.

4. Device according to claim 2, wherein the opaque plates are adjacent to each other and are coplanar and located under the upper side of the receptacle.

5. Device according to claim 1, wherein the draw element has at least two printed columns.

6. Device according to claim 5, wherein the at least two printed columns contain the results of the draw.

7. Device according to claim 1, wherein the random draw device is computerized.

8. Device according to claim 1, wherein the central processing unit is connected to mechanical random draw devices through a third interface.

9. Device according to claim 1, wherein the random draw device uses a computerized routine controlled by the central processing unit for generation of a draw in accordance to the modality of the draw selected by the player.

10. Device according to claim 1, further comprising a feeder with sufficient quantity of paper to satisfy a high paper consumption including a roll connected to a motor reducer driven shaft that is activated by stroke limits between which there is a fluctuating loop which maintains constant tension according to traction suitable to a traction mechanism of the printer.

11. A method for use with gaming machines for the resolution of the modality of prior draw, which uses the device of claim 1, and which begins once a type of bet and draw is selected by a player, the method comprising:

a) selecting a draw modality using a reduced alphanumeric keyboard or a touch screen monitor, which is then communicated to a central processing unit through a first interface;

b) activating a random draw device which is connected to the central processing unit and which would carry out the appropriate and random draw for the draw modality selected;

c) printing the result of the draw selected and executed in the random draw device in a draw element, in a such a way that it is visible to the player, through a second interface which connects the central processing unit with a printer;

d) transferring the draw element to a transparent receptacle that includes occlusion means for hiding that part of the draw element which contains the results of the draw;

e) depositing an amount to be wagered through a betting slot;

f) placing the bet on a basis of the draw modality selected in step a) by via the reduced alphanumeric keyboard or the touch screen monitor;

g) deactivating, once the bet has been made, either sequentially or at the same time, the occlusion means which are covering the draw element which contains the result of the draw;

h) repeating steps e), f), g) according to the modality of the draw selected in step a) anchor according to a wish of the player or otherwise handing over the draw element to the player as proof of the draw executed.

* * * * *